United States Patent [19]

Evans

[11] 4,149,594

[45] Apr. 17, 1979

[54] RETRIEVABLE BRIDGE PLUG

[75] Inventor: Robert W. Evans, Houston, Tex.

[73] Assignee: Baker International Corporation, Orange, Calif.

[21] Appl. No.: 851,007

[22] Filed: Nov. 14, 1977

[51] Int. Cl.[2] ..... E21B 23/06; E21B 23/128

[52] U.S. Cl. ..... 166/134; 166/133

[58] Field of Search ..... 166/120, 134, 123–125

[56] References Cited

U.S. PATENT DOCUMENTS

| | | | |
|---|---|---|---|
| Re. 28,641 | 12/1975 | Chenoweth | 166/120 |
| 2,854,080 | 9/1958 | Dale et al. | 166/120 X |
| 3,412,801 | 11/1968 | Young | 166/120 |
| 3,437,136 | 4/1969 | Young | 166/120 |

FOREIGN PATENT DOCUMENTS

| | | | |
|---|---|---|---|
| 1032903 | 6/1966 | United Kingdom | 166/120 |

*Primary Examiner*—Ernest R. Purser

*Attorney, Agent, or Firm*—William C. Norvell, Jr.

[57] ABSTRACT

A well tool is provided which is adaptable to be moved longitudinally within a well conduit. The tool contains normally retracted slip elements which are manipulated into engagement with the conduit by expander elements. An elastomeric packing element, of known construction, is expandable exteriorly around the well tool and is adapted to selectively seal with the well conduit. Booster means are provided for transmitting the compressive force defined by differential pressure acting across the packing element when the slips are in expanded position against the conduit and the packing element is sealed with the well conduit, such that the packing element is maintained in sealing relationship with the well conduit.

12 Claims, 17 Drawing Figures

RETRIEVABLE BRIDGE PLUG

BACKGROUND OF THE INVENTION

1. FIELD OF THE INVENTION

The invention relates to a retrievable bridge plug assembly incorporating therein a booster assembly which permits maximum pressure to be applied to the packoff elements when the bridge plug is subjected to differential pressure in either direction subsequent to setting of the tool.

2. DESCRIPTION OF THE PRIOR ART

Heretofore, it has been difficult to keep pack-off elements of retrievable bridge plugs completely out and sealingly interfaced with the casing such that they do not relax when pressure differential causes deformation of the casing and the slips to bite in further into the casing. Accordingly, component parts of the bridge plug will elongate, and the integrity of the packing seal may be lost.

When a bridge plug is set by a pull-push technique, some of the set down force and pull up force is locked into the packing elements. The bridge plug will hold pressure from above because the pressure working on the area of the bridge plug body urges the packing element into tighter interface with the wall of the casing. If pressure is applied or encountered below the body which is higher than that from above, the interior or mandrel of the bridge plug will tend to be urged upwardly causing the lower slips to bite into the casing even further and thus relieve some of the set down force locked into the packing elements. The resulting casing deformation may be sufficient to enable the packing elements to become relaxed so that the pressure holding capability from below is lost because no external force is applied to keep the packing elements in compression against the casing. In other words, if sufficient pack-off pressure is mechanically applied to the packing element system to form an initial seal and then is locked in to create a fixed volume which confines the packing elements, then the packing elements will hold a pressure differential up to the pressure and temperature limits of the elements themselves. However, if the fixed volume is allowed to increase, the packing elements will relax and the tool will not hold pressure. If the process of increasing the pressure differential across the tool also tends to increase the fixed volume, the bridge plug will hold only that pressure required to increase the fixed volume sufficiently to allow the packing elements to relax and then will lose all pressure integrity. Factors which increase the fixed volume are: (1) the locking system assembly and operation; (2) slip travel due to teeth increasing engagement with the casing, casing expansion, and/or casing deformation; (3) casing expansion at the slip and pack-off elements due to pressure variation; (4) axial deformation of parts of the bridge plug subjected to tension and compression load; and (5) an extrusion of the packing elements over the immediate gauge or other urging devices.

The present invention provides a booster assembly which obviates the problems set forth above. If the packing elements contain a minimum initial seal, then the booster sleeve assembly will cause the fixed volume to remain the same or decrease with an increase in pressure differential. Thus, the fixed volume becomes independent of the variables set forth above as long as the pressure differential is maintained and complete failure by extrusion does not occur.

SUMMARY OF THE INVENTION

The invention relates to a well tool which is adaptable to be set in a conduit of a well bore. The tool has a body structure having thereon a normally retracted means. Means which are responsive to movement of the body structure in one direction relative to the normally retracted means are provided for expanding the normally retracted means outwardly into engagement with the conduit. Elastomeric packing means are expandable exteriorly around the body structure and are adapted to selectively seal with the conduit. A booster sleeve is defined immediate the packing means and provides an effective pressure area thereacross for transmitting a compressive force resulting from differential pressure acting on the packing means to the packing means when the packing means are in sealing relationship with the conduit. In a preferred form, a first releaseable clutch acts between the body structure and the normally retracted means for preventing movement of the body structure relative to the retracted means. Also, in a preferred form, a second normally released but selectively engageable clutch element is provided which acts between the body structure and the normally retracted means for permitting movement of the body structure relative to the normally retracted means to urge the normally retracted means outwardly and then to engagement with the conduit and to selectively lock the normally retracted means in the outwardly expanded position.

DESCRIPTION OF THE PREFERRED EMBODIMENTS

Figure 1:
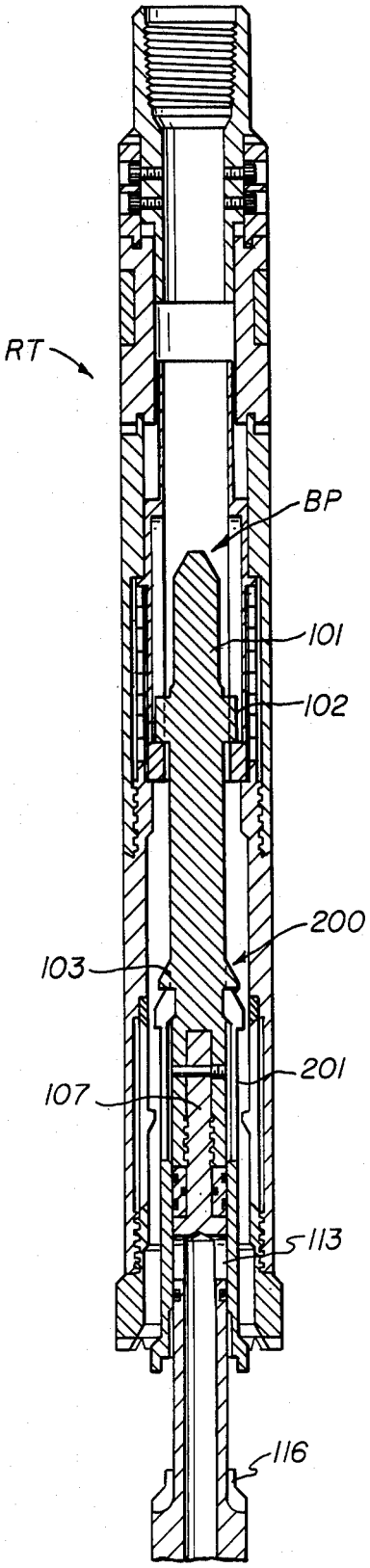
FIG. 1 is a partial longitudinal sectional drawing illustrating the uppermost portion of the bridge plug affixed to a running and retrieving tool in preparation for insertion within the casing of a subterranean well.
Figure 3:
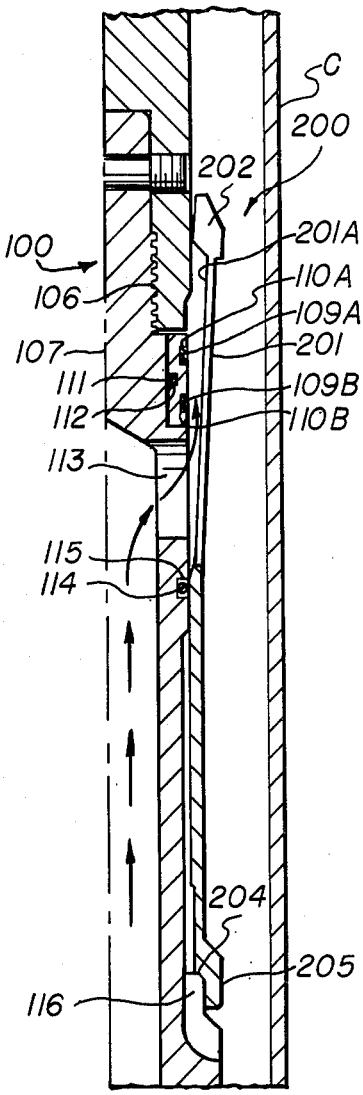
FIG. 3 is an enlarged partial sectional view of the position illustrated in FIG. 2 showing the unloader assembly in open position to equalize pressure across the bridge plug prior to the setting operation.
Figure 2:
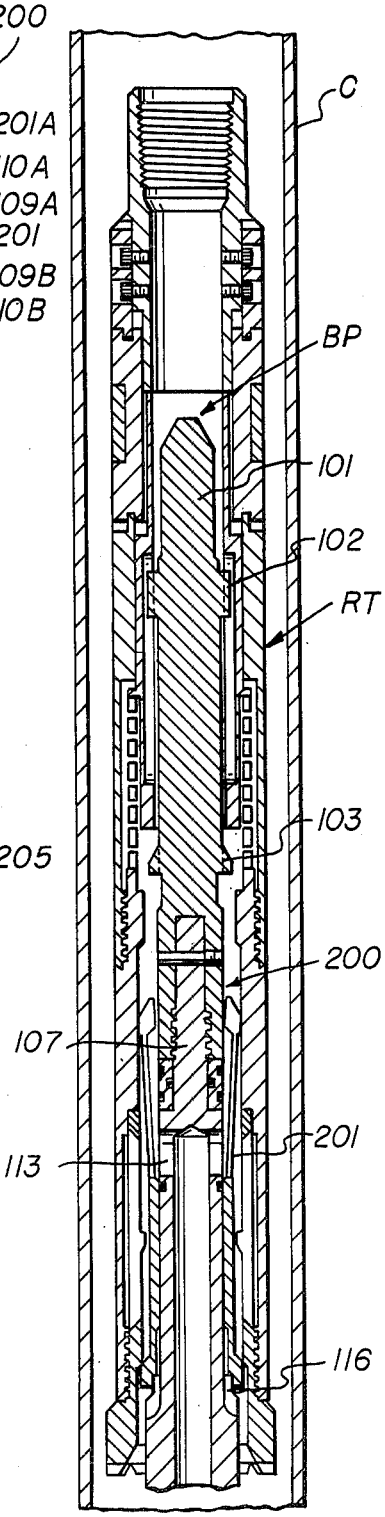
FIG. 2 is a view similar to that illustrated in FIG. 1, showing the running and retrieving tool manipulating an unloader assembly to open position.
Figure 4A:
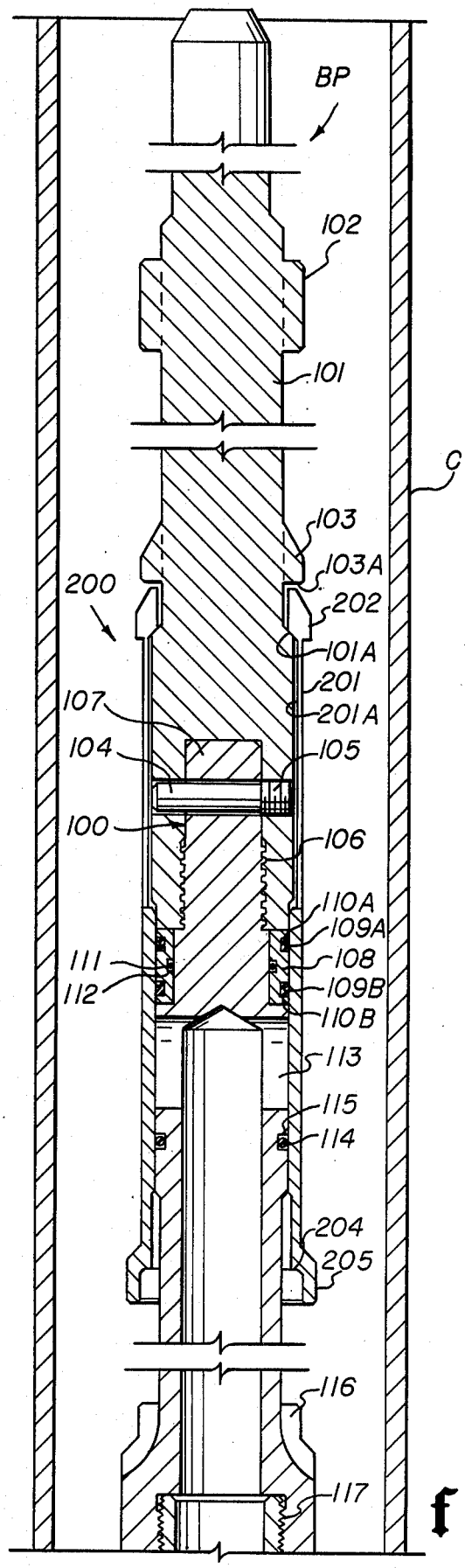
FIGS. 4A, 4B 4C and 4D are continual longitudinal sectional views of the bridge plug prior to the setting of the tool within the well.
Figure 4B:
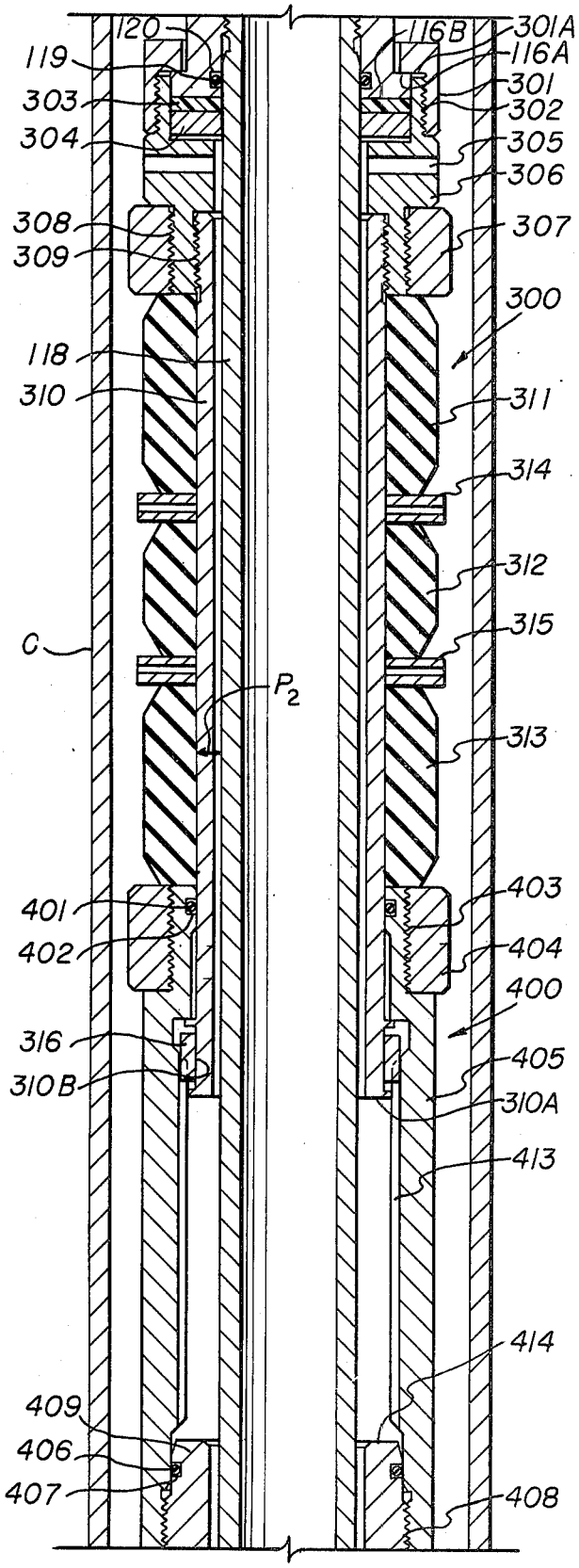
Figure 4C:
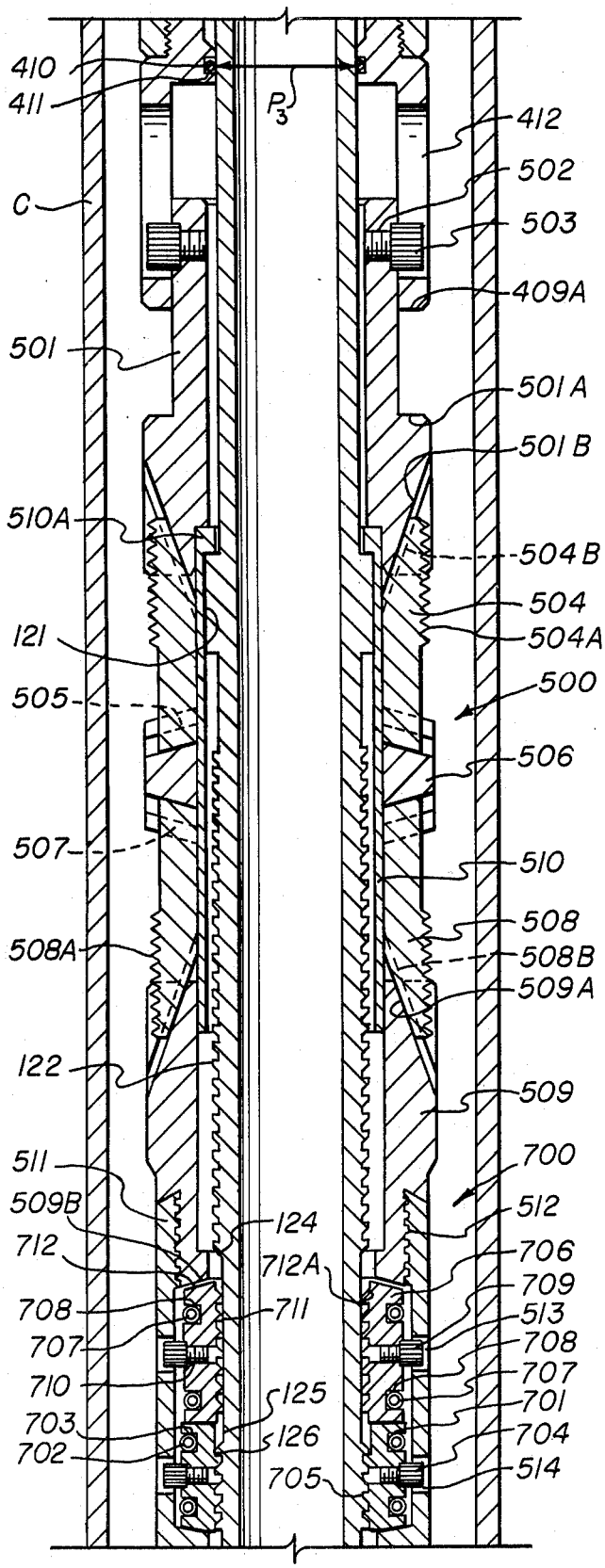
Figure 4D:
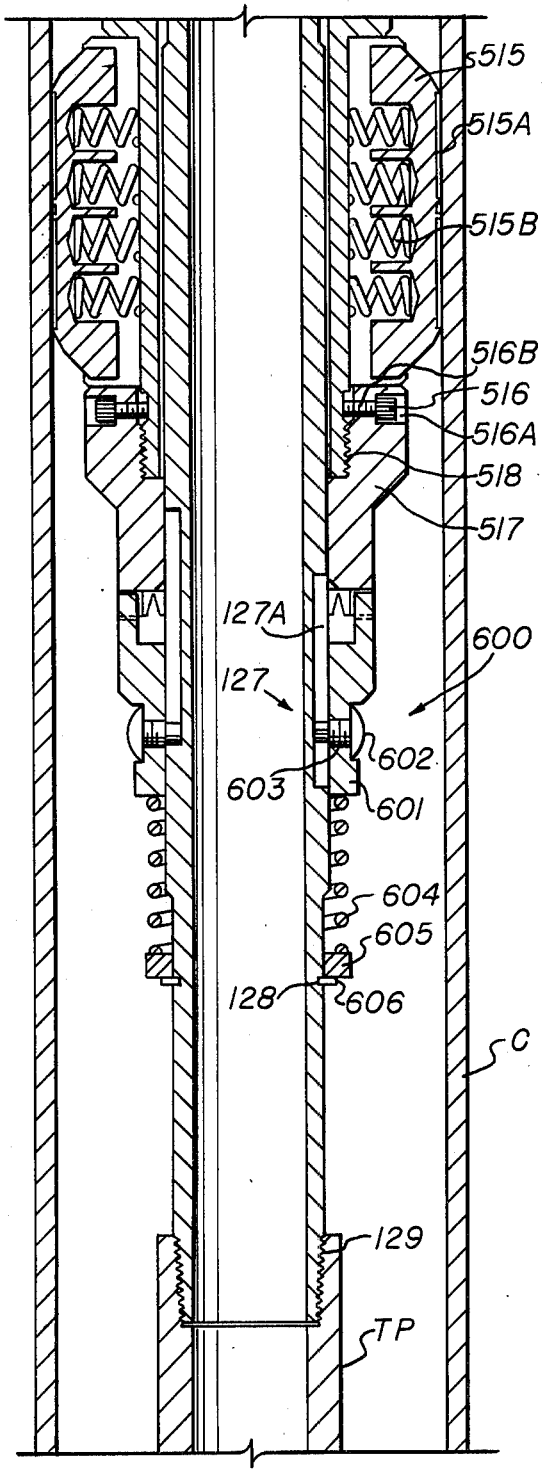
Figure 5A:
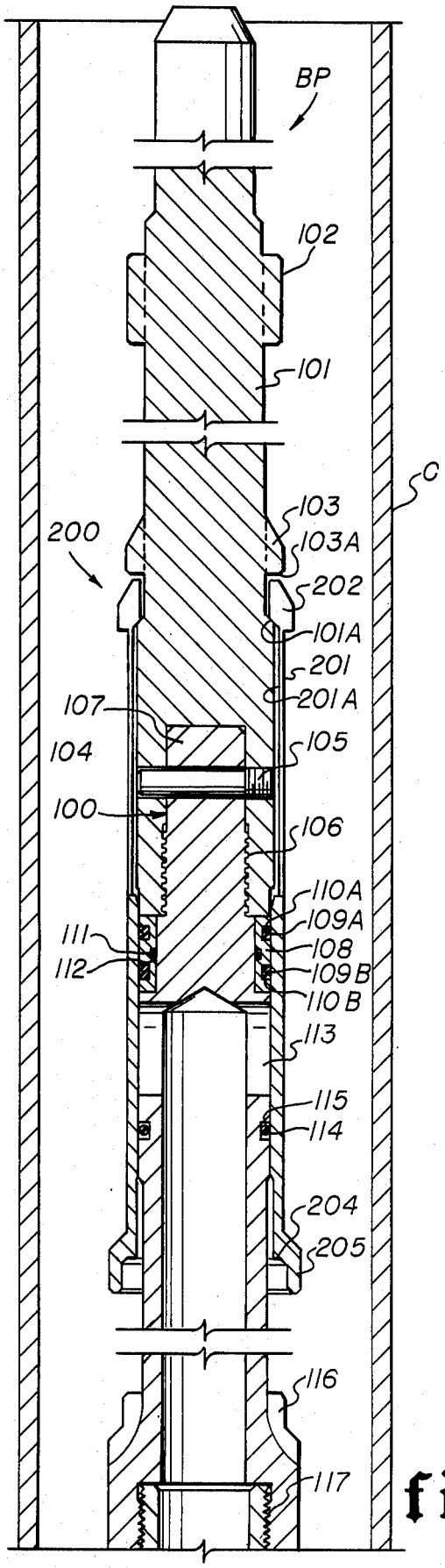
FIGS. 5A, 5B, 5C and 5D are sectional views similar to those illustrated in FIGS. 4A through 4D, showing the bridge plug in set position.
Figure 5B:
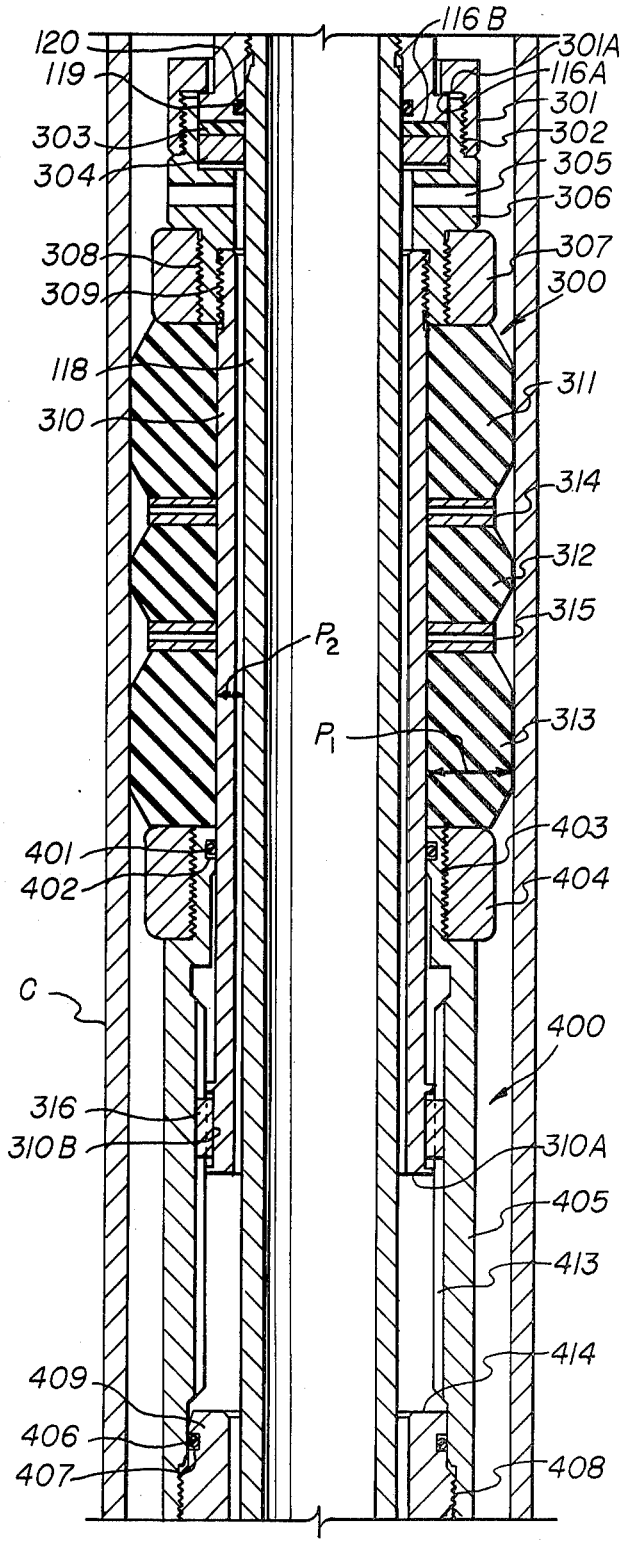
Figure 5C:
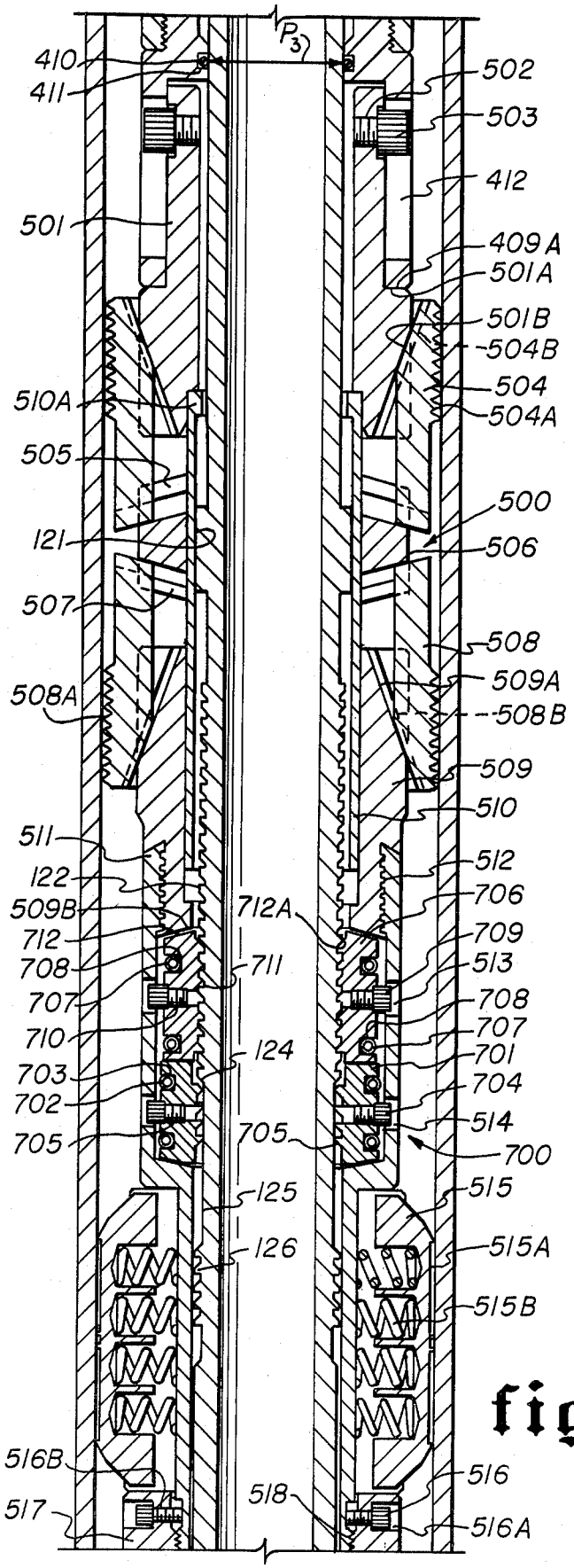
Figure 5D:
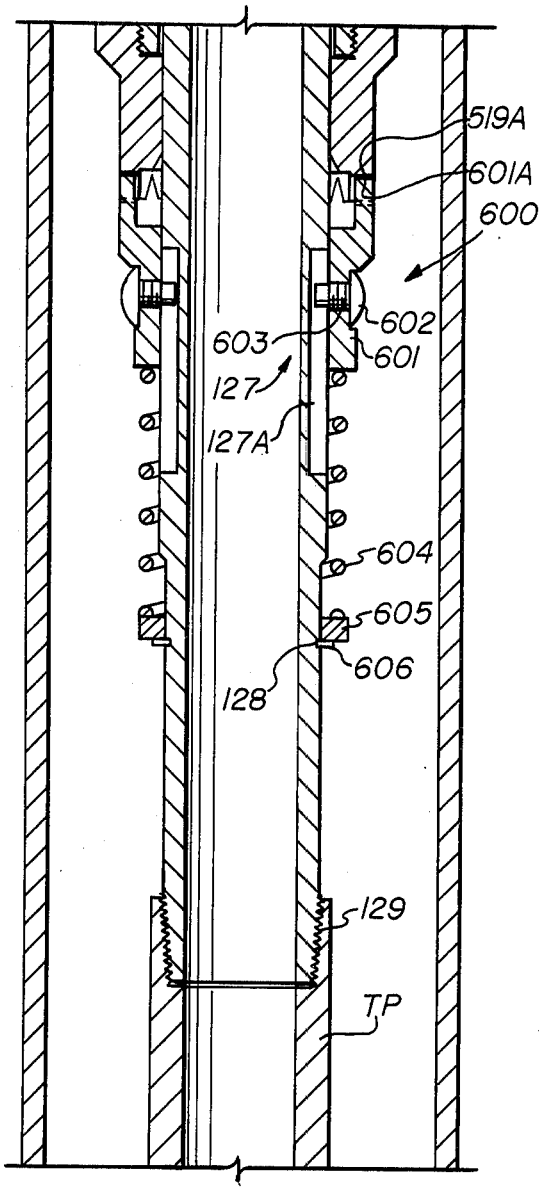
Figure 7:
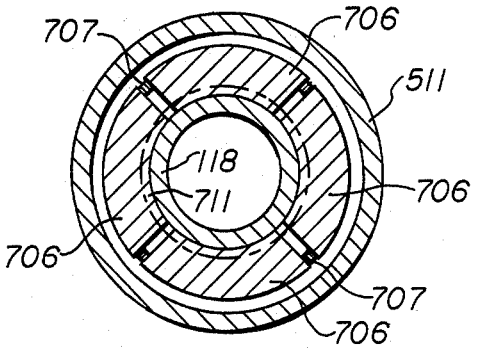
FIG. 7 is a cross-sectional view taken along lines 7—7 of FIG. 6.
Figure 9:
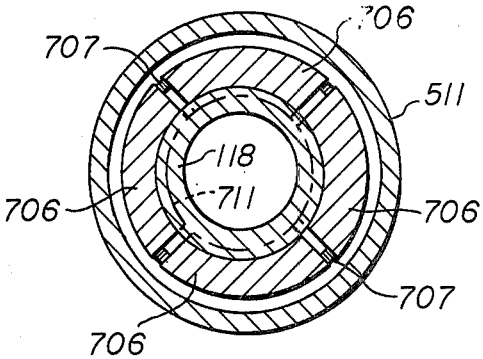
FIG. 9 is a cross-sectional view taken along lines 9—9 of FIG. 8.
Figure 6:
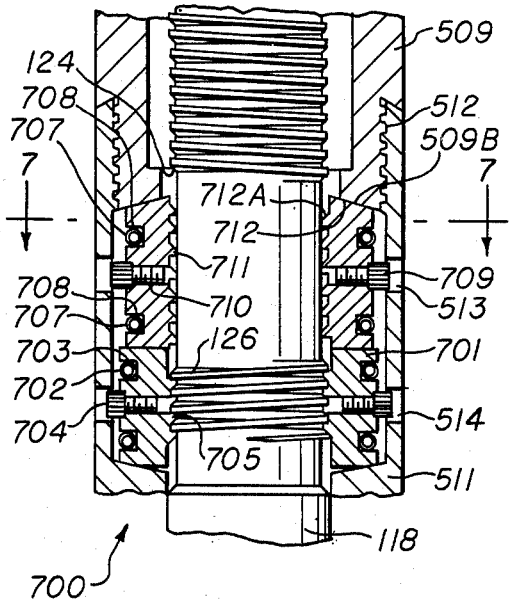
FIG. 6 is a partial longitudinal sectional view illustrating control and lock assembly positioning prior to the setting of the bridge plug.
Figure 8:
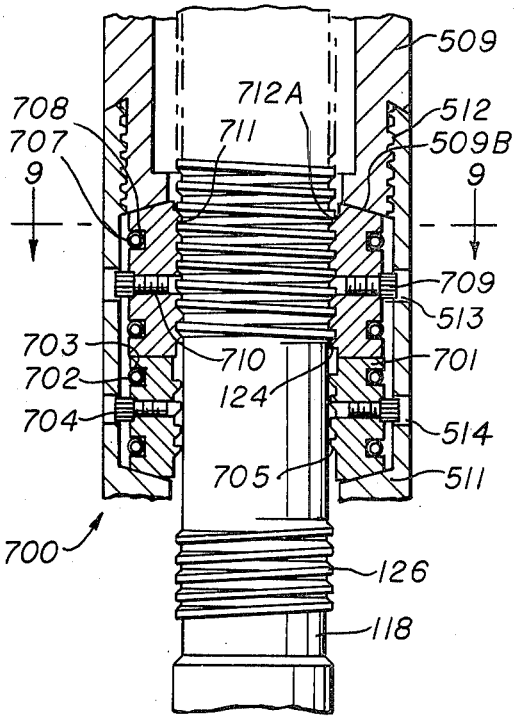
FIG. 8 is a partial longitudinal sectional view, similar to that shown in FIG. 6, illustrating the control and lock assembly in position subsequent to the setting of the bridge plug.
Figure 10:
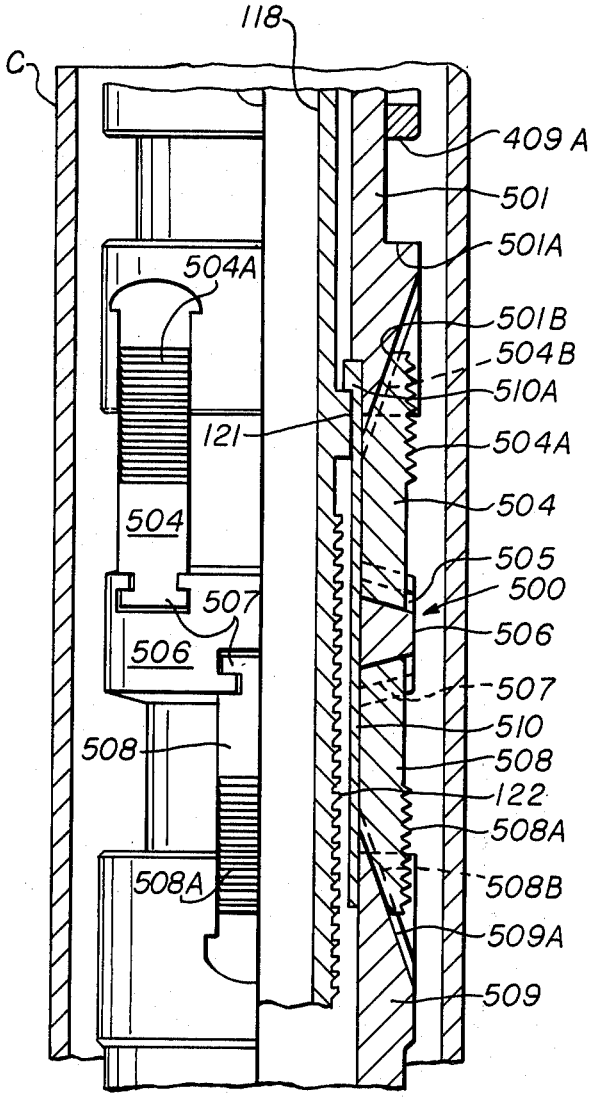
FIG. 10 is a partial elongated and enlarged side and exterior view of the slip assembly of the bridge plug prior to setting upon the wall of the casing.
Figure 11:
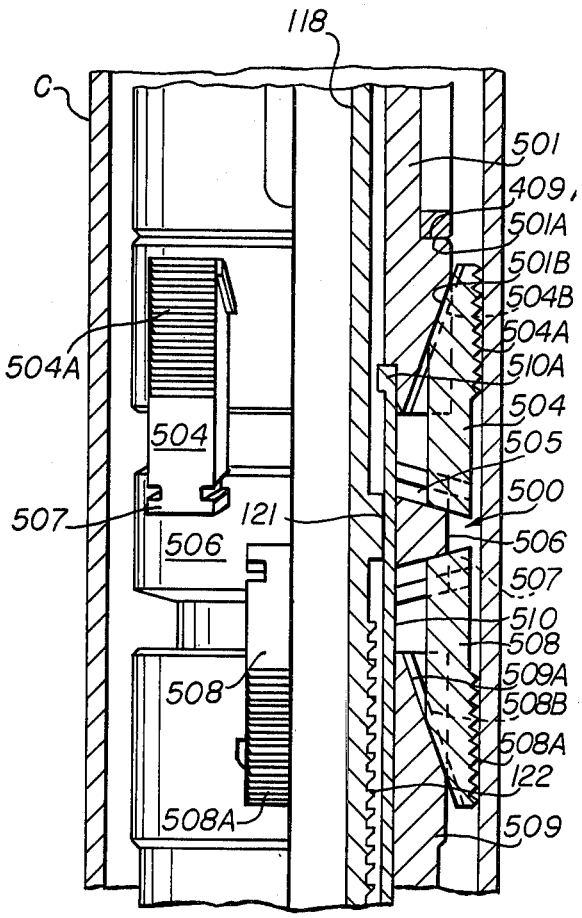
FIG. 11 is a view similar to that shown in FIG. 10 illustrating the position of the slip assembly subsequent to the setting of the bridge plug.

As shown in FIGS. 4A through 4D, the bridge plug BP basically is comprised of an inner housing 100, an unloader assembly 200 defiend immediate the uppermost end of the inner housing 100 and exteriorly therearound, a pack-off assembly 300 below the unloader assembly 200, and also defined centrally and exteriorly around the inner housing 100, a booster assembly 400 carried by the pack-off assembly 300 and functional therewith, a slip assembly 500 immediately below the booster assembly 400, a clutch assembly 600 defined exteriorly of and at the lowermost end of the inner housing 100, and a control and lock assembly 700 between the inner housing 100 and the slip assembly 500.

The inner housing 100 has defined at its uppermost end a longitudinally extending J-pin mandrel 101 which is selectively manipulated by a running and retrieving tool RT (FIG. 1), of conventional and known construction, which is selectively affixed to the J-pin mandrel 101 by means of outwardly protruding J-pins 102. The mandrel 101 also has exteriorly defined thereon a beveled protrusion 103 having an end 103A facing a plurality of circumferentially spaced collet finger 202 on the unloader sleeve 201 of the unloader assembly 200. The protrusion 103 is functional in association with a companion element on the running and retrieval tool RT to manipulate the unloader sleeve 201 as described below. A bevel 101A immediately below the protrusion 103 on the mandrel 101 shoulders against the collet finger element 202 of the sleeve 201 until disengaged by manipulation of the running and retrieval tool RT.

An elongated seal mandrel 107 is carried by the J-pin mandrel 101 and is affixed thereto by means of threads 106. Additionally, a retaining pin 104 is secured by means of threads 105 through the mandrel 101 and into the uppermost end of the seal mandrel 107, the retaining pin 104 permitting torque in either direction as the tool is inserted or retrieved to or from down hole positioning. The seal mandrel 107 carries exteriorly thereof an unloader seal assembly 108 having within upper and lower exteriorly and circumferentially defined grooveways 110A and 110B, respectively, rubber elements 109A and 109B which are functional with the unloader sleeve 201 defined exterior thereof to prevent fluid communication between the sleeve 201 and the seal mandrel 107. An elastomeric O-ring seal element 111 is defined within a grooveway 112 on the unloader seal assembly 108 to prevent fluid communication between the unloader seal assembly 108 and the seal mandrel 107. A similar, though enlarged, O-ring element 114 is defined with a grooveway 115 in the seal mandrel 107 and also prevents fluid communication between the mandrel 107 and the sleeve 201 exterior thereof. A port 113 is bored within the mandrel 107 between the seal rings 111 and 114, and is normally closed off to prevent communication between the interior of the bridge plug BP and the annular area between the casing C and the bridge plug BP by means of the sleeve 201. However, as the sleeve 201 is shifted, the port 113 permits communication between the bridge plug-casing annulus and the interior of the bridge plug BP. Immediately below the ring 114 on the mandrel 107 is an outwardly extending abutment element 116, in series, which defines the lower end of travel of the unloader sleeve 201 and is engaged by the ends 204 and outer abutments 205 of the sleeve 201, as described below.

The inner housing 100 is continued below the mandrel 107 by means of a longitudinally extending cylindrical body element 118 which is affixed to the mandrel 107 by means of threads 117, an elastomeric O-ring element 119 defined within a grooveway 120 on the mandrel 107 preventing fluid communication between the mandrel 107 and the body 118. The body 118 has defined exterior thereof the pack-off assembly 300, the booster assembly 400, the slip assembly 500, and the clutch assembly 600, with the control and lock assembly 700 being operationally carried thereon. An outwardly abutting protrusion 121 is defined on the body 118 for companion shouldering of a shoulder 510A defined as the uppermost end of a longitudinally extending sleeve element 510 within the slip assembly 500, to assure proper assembly of the slip assembly 500 with other component parts of the bridge plug BP. Immediately below the protrusion 121 and circumferentially defined around the exterior of the body 118 are a series of buttressed left-hand thread elements 122 which selectively receive companion thread elements 711 on a lock segment 706 of the control and lock assembly 700 during the setting of the bridge plug BP within the casing C. A buttressed end 124 defined as the lowermost element of the threads 122 is provided for shouldering upon the upper face 712 of the lock segment 706 to urge the segment 706 outwardly and away from the threads 122 fo initial co-engagement of the threads 122 and 711 to permit continued downward travel of the body 118 during the setting operation as described below. Similar, but righthand, threads 126 also are defined on the body 118 for co-engagement of threads 705 carried on a control element 701 of the control and lock assembly 700, an undercut elongate 125 being defined on the body 118 between the threads 122 and threads 126 for smooth interfacing with the control element 701 as the bridge plug BP is being set. Immediately interior of the clutch assembly 600 and on the body 118 of the housing 100 is a longitudinally extended slot 127A for receipt therein of an inwardly protruding clutch pin 602, the pin 602 and the slot 127A defining a key assembly 127 to insure that the bridge plug BP is not blocked with excessive rotation prior to the setting operation as described below. Immediately below the slot 127A is an exterior engroovement 128 for receipt of a stop ring retainer 606 of the clutch assembly 600. The lowermost end of the body 118 has defined thereon threads 129 for engagement of tail pipe TP, a junk basket or an opened ended guide element.

The unloader assembly 200, which is defined exterior of the housing 100, has elongated collet fingers 202 which bridge the J-pin mandrel 101 and the seal mandrel 107. The fingers 202 permit selective opening and closing of the port or passageway 113 in the mandrel 107 to open a communication path between the lower end of the bridge plug BP and the top thereof. Thus, downward manipulation of the sleeve 201 permits equalization of the pressure immediate the bridge plug BP. Additionally, after utilization of the bridge plug BP and when retrieving same from the selected location within the well, the port 113 again is opened by shifting of the sleeves 201 by the running and retrieval tool RT to open a path between the annular area between the bridge plug BP and the casing C and the interior of the bridge plug BP to again permit equalization of pressure from below to above so that the well is under control before the bridge plug pack-off assembly 300 is disengaged from sealing engagement with the casing C.

The unloader sleeve 201 bridges the port 113, with the rubber elements 109A and 109B, together with the O-ring 114, preventing fluid communication between the sleeve 201 and the mandrel 107. At the uppermost end of the sleeve 201 are a plurality of finger elements 202 which normally are contained within a housing defined by the bevel 101A and end 103A on the mandrel 101. Each finger 202 is normally flexed inwardly and is shifted by the running and retrieval tool RT to permit longitudinal movement of the sleeve 201 to selectively open the port 113. The I.D. of the sleeve 201 is expanded somewhat within its approximate upper one-half, this I.D. being defined as 201A, such that when the sleeve is shifted downwardly by the running and retrieval tool RT, the area 201A passes immediate the port 113, and this expansion thus defines a flow passageway which permits fluid to be communicated between the annular area between the bridge plug BP and the casing C, within the unloader sleeve 201 and the port 113 to or from the interior of the housing 100. The sleeve 201 has an end 204 and an outer abutment 205 for companion engagement along a shoulder 116 on the seal mandrel 107, which defines the lowermost end of travel of the sleeve 201.

The pack-off assembly 300 is selectively manipulatable by the longitudinal movement of the drill or other string affixed to the tool RT to cause the tool RT, which is interfaced with the bridge plug BP at the J-pins 102, to seal off the annular area between the casing C and the bridge plug BP to perform the remedial function at the desired location within the well. Additionally, the pack-off assembly 300 also transmits tubing weight and torque from the inner housing 100 to set the slip assembly 500 therebelow. The pack-off assembly 300 has a lock nut 301 having an inwardly protruding upper shoulder 301A which interfaces with a companion outwardly extending lower shoulder 116A on the end of the seal mandrel 107. Affixed to the lock nut 301 by means of threads 302 is a bearing housing 306 encapsulating therein a bearing element 303 which is carried between the seal mandrel 107 and a bearing race element 304 within the housing 306, exterior of the body element 118, the bearing 303 permitting transmission of torque between the inner housing 100 and the component parts of the bridge plug BP exterior thereof, such as the pack-off assembly 300, etc. The housing 306 also has defined therein a latitudinal passageway 305 which assures entrance and transmission of pressure from above the bridge plug BP between a connector sleeve 310 of the pack-off assembly 300 and the body 118 of the inner housing 100 to act on the booster area, described below.

The housing 306 also provides an outwardly protruding gauge ring 307 which is affixed to the housing 306 by means of threads 308, the ring 307 functioning to convert the bridge plug BP from one size to another by changing only a limited number of component parts. Additionally, the gauge ring 307 shields pack-off elements of the assembly 300 therebelow as they are being inserted within the casing C. The gauge ring 307 is the uppermost ring of an upper and lower series of rings, the lower gauge ring being indentified as 404 which is affixed by threads 403 to a booster sleeve 405 in the booster assembly 400.

The pack-off assembly 300 continues lowerly of the gauge ring 307 by means of a connector sleeve 310 which is affixed to the housing 306 by means of threads 309. The sleeve 310 houses a series of upper and lower elastomeric pack-off elements 311 and 313 which, when engaged with the wall of the casing C, serve to isolate the annular area between the casing C and the bridge plug BP and prevent fluid transmission above and below the packing elements. A similar, but somewhat smaller, pack-off element 312 is defined between the pack-off elements 311 and 313, with companion spacing elements 314 and 315 bridging the elements 311, 312 and 313. A floating key 316 is carried in a slot 310B immediate the lowermost end 310A of the connector sleeve 310, the key 316 being received within the splineway 413 defined interior of the sleeve 405 in the booster assembly 400, the key 316 and the splineway 413 preventing relative rotational movement between the connector sleeve 310 and the sleeve 405 exterior thereof, but permitting the connector sleeve 310 to move longitudinally therealong until such time as the end 310A contacts the upper end 414 of the tie sleeve 409 therebelow.

The booster assembly 400 is carried exterior of the inner housing 100 and immediately below the pack-off assembly 300 and has defined as its uppermost end the lowermost gauge ring 404 which is affixed by threads 403 to a longitudinally extending sleeve 405, an elastomeric O-ring seal 401 defined within a grooveway 402 on the sleeve 405 preventing communication of fluid between the sleeve 405 and the connector sleeve 310. The sleeve 405 is a booster sleeve element assisting in assuring continued maximum pack-off of the elements 311, 312 and 313 with the casing C after the bridge plug BP has been set.

If sufficient pack-off pressure is mechanically applied to the pack-off assembly 300 to form an initial seal and then is locked in to create a fixed volume which confines each of the packing elements 311, 312 and 313, then these elements will hold a pressure differential up to the pressure and temperature limits of each of the elements. However, if the fixed volume is allowed to increase, then each of the packing elements will relax and the bridge plug BP will not be permitted to hold pressure. If the process of increasing the pressure differential across the bridge plug BP tends to increase the fixed volume, then the bridge plug BP will hold only that pressure which is required to increase the fixed volume sufficiently to allow the packing elements to relax, and then will thereafter lose all pressure integrity. If the packing elements 301, 312 and 313 contain a minimum initial seal, then the booster sleeve 405 will cause the fixed volume to remain the same or decrease with an increase in pressure differential when pressure from below the pack-off assembly 300 is higher than that thereabove. Thus, the fixed volume becomes independent of factors such as the particular utilized locking system, travel of slips due to teeth thereon increasing engagement with the casing, casing expansion, and/or casing deformation, casing expansion at the pack-off elements due to pressure, axial deformation of parts of the bridge plug BP subjected to tension and compression loading, and extrusion of the packing elements around the gauge rings 307 and 404, as long as the pressure differential is maintained and complete failure by extrusion does not occur.

The booster sleeve 405 is functional in association with three general pressure areas on the bridge plug BP. The first pressure area, defined as P1 in the drawings, is the annular cross-sectional area between the I.D. of the casing and the I.D. of the O-ring 401. The second pressure area is defined as P2, is referred to below as the "booster area", and is the annular crosssectional area defined by the I.D. of the O-ring 401 on the sleeve 405 and the I.D. of the O-ring 410 on the tie sleeve 409. The third pressure area is defined in the drawings as P3, and is defined as the cross-sectional area of the body 118 at the inner diameter of the ring 410 in the groove 411.

The booster assembly continues lowerly of the sleeve 405 and terminates by means of a tie sleeve 409 affixed by threads 408 to the sleeve 405, O-rings 406 and 410 within their bores 407 and 411 preventing fluid communication between the sleeves 405 and 409, and the sleeve 409 and the body 118, respectively. The tie sleeve contains a longitudinally extending slot 412 for travel therein of a screw 503 during setting and release of the slip assembly 500 and during activation of the booster sleeve 405 to maintain the seal integrity of the packing elements 311, 312 and 313. The lower end 409A of the tie sleeve 409 contacts and engages the upper shoulder 501A of the upper cone 501 to transfer weight to force the slips 504 into engagement with the casing C.

The slip assembly 500 is carried exterior of the body 118 immediately below the booster assembly 400. An upper cone 501 defines the uppermost end of the slip assembly 500 and is operably received within the longitudinal slot 412 in the tie sleeve 409 by means of the protruding screw or pin 503 which is affixed by threads 502 to the uppermost end of the cone 501. The cone 501 also contains an outwardly protruding shoulder 501A for interface with the end 409A of the tie sleeve 409 during manipulation as described below. The upper cone 501 contains a series of rotationally spaced slots exterior of the body 118 and functions to urge slip elements 504 therebelow into engagement with the inner wall of the casing C to secure the bridge plug BP, the cone 501 containing a bevel 501B which receives a companion elongate 504B on the slip 504 for urging the slip 504 outwardly as the cone 501 is shifted downwardly. Each slip 504 has exteriorly defined teeth 504A for grasping the inner diameter of the casing C during the setting operation. Similar slip elements 508 are secured to the slip 504 by means of a ring 506, the ring 506 being secured to the slips 508 by means of protrusions 507 on the slips which engage the slots 505 on the ring 506. Each lower slip 508 also has outwardly protruding teeth 508A for engagement with the casing C.

Interior of the upper and lower slips 504 and 508 and the ring 506 is an extended sleeve 510 which prevents the slips 504 and 508 from extending inwardly to the body 118. A protrusion 510A is engagable by a companion shoulder or protrusion 121 on the body 118 for carriage of the sleeve 510 during longitudinal manipulation of the slip assembly 500.

The lower slip assembly 508 is beveled at 508B on its lower end for slidable travel of a companion bevel 509A on a lower cone 509, the slips and cones being rotationally spaced around the exterior of the body 118.

Te lower cone 509, similar in construction and function as the upper cone 501, has a lower face 509B which, subsequent to the setting operation, interfaces with an upwardly facing face 712 of a lock segment 706 carried on the body 118 between the body 118 and an outer drag block housing 511. The cone 509 is secured at threads 512 to the drag block housing 511, the housing 511 having first and second companion bores 513 and 514 for protrusion therethrough of pin elements 709 and 704 on the lock segment 706 and the control segment 701, respectively. The drag block housing 511 carries a series of outwardly extending blocks 515 having an outer surface 515A of tungsten carbide or nickel, or the like, for slidable travel along the casing C as the bridge plug BP is run into the well and set, tool weight being supported on the drag blocks 515 prior to engagement of the upper and lower slips 504 and 508 onto the casing C and subsequent to the control segment 701 being threadedly released from the body 118. Each drag block 515 is urged outwardly by a plurality of spring elements 515B carried interiorly thereof, one end of the springs 515B contacting the outer diameter of the drag block housing 511 to urge the drag block face 515B along the inner wall of the casing C so that axial or rotational motion of the bridge plug BP is resisted, the face 515A being extended into contact with the inner wall of the casing C.

The drag block housing 511 is, in turn, secured by threads 518 to a retainer 517 below the drag blocks 515. A set screw 516 is insertable within a bore 516A and is secured to the retainer 517 by means of threads 516B, the set screw 516 further securing the retainer 517 to the drag block housing 511. A series of downwardly protruding teeth elements 519A are carried on the lowermost end of the retainer 517 for co-engagement of complementary teeth 601A carried on a clutch 601 therebelow.

The clutch assembly 600 defines the lowermost end of the exterior of the bridge plug BP around the body 118, the teeth 601A for companion engagement with the teeth 519A forming the uppermost end of a clutch 601, the clutch 601 receiving therethrough a clutch pin 602 which is secured to the clutch 601 by means of threads 603, the pin 602 protruding interiorly through a slot 127A within the body 118 for formation of a key 127. The clutch 601 is urged normally upwardly by means of a compressed spring element 604 which is carried between the clutch 601 and a stop ring 605 therebelow, the stop ring 605 being positioned by means of a circumferentially carried retainer 606 housed within a groove 128 on the body 118. The clutch assembly 600 assures that the bridge plug BP is not blocked with excessive rotation prior to the setting operation. While positioning the bridge plug at the desired position in the casing, rotation of the drill string or tubing to the left may be experienced and excessive torque might be encountered such that the threads which engage the control element 701 and the body 118 become so tightly interengaged that force on the drag blocks 515 is not sufficient to assist in separation of the body 118 from the control element 701 at the threads 126. Therefore, the clutch assembly 600, having teeth 601A and 519A intermeshable, permits a rotation in one direction only, i.e., to the right. However, the clutch assembly 600, by means of key assembly 127, is secured to the body 118 so that the body 118 is permitted to move longitudinally upwardly of downwardly. When the bridge plug BP is set down hole, the retainer 517 is urged upwardly to disengage the clutch assembly 600 at the teeth 519A and 601A, such that the teeth move axially by means of the key 127 and the spring 604, but rotation therebetween is prevented.

A control and lock assembly 700 is defined between the body 118 and the slip assembly 500. A control element 701 is secured within the drag block housing 501 and onto the body 118 by means of threads 126, the control element 701 having an outwardly protruding pin element 704 which is secured within the element 701 by means of threads 705 to function as a rotational stop to prevent rotation of the control element 701 with respect to the drag block housing 511. The element 701 is normally kept onto the body 118 and inwardly of the housing 511 by means of the threads 126, but are permitted to be removed from the threads 126 during the ratcheting function, described below. The elements 701 define upper and lower grooves 703 for receipt therearound of a garter spring element 702 which urges the element 701 inwardly to cause a radial load on the control element 701 to keep the element 701 inward in engagement with the body 118. Immediately above the control element 701 is a lock segment 706 which contacts the body 118, but is not engaged thereon, along the undercut 125. The interior of the segment 706 has a thread element 711 defined therealong for selective companion engagement with left-hand threads 122 on the body 118 immediately above the undercut 125. A beveled downwardly facing shoulder 712A is defined at the upper end of the lock segment 706 for shouldering with the companion end 124 at the bottom end of the threads 122 on the body 118 to shift the segment 706 outwardly for initial co-engagement of the threads 122 and 711. The segment 706 normally is urged inwardly by a plurality of upper and lower garter spring elements 707 which are secured within grooves 708 in the segment 706 to urge the segment 706 inwardly. An outwardly protruding pin element 709 is secured to the lock segment 706 by means of threads 710 and is receivable within the bore 513 of the drag block housing 511. When the segment 706 is urged outwardly as the threads 711 and 122 are interengaged, the springs 707 are normally urging the segment 706 toward interface with the undercut 125 and away from contact with the inner diameter of the drag block housing 511, prior to the setting operation. The pin 709 functions as a rotational stop with respect to the drag block housing 511 to prevent rotational movement therewith during the setting operation.

OPERATION

When it is desired to conduct a remedial operation, such as acidizing or chemical injection within a well, the bridge plug BP is run on a tubular string having the running and retrieval tool RT affixed at the lower end thereof, the running and retrieval tool RT carrying the bridge plug BP on the pins 102 on the J-pin mandrel 101. The bridge plug BP is run to the desired depth for setting within the well and within the interior of the casing C. While running the bridge plug BP to the desired depth and before setting of the bridge plug BP, the tubing string and the tool RT are manipulated to shift the unloader sleeve 201 out of engagement along the bevel 101A to open a communication path from below to the top of the bridge plug to allow pressure from below to communicate to above, if higher, or allow pressure from above to communicate to below, if lower, in order to permit pressure equalization across the bridge plug BP. The running and retrieval tool RT engages the inwardly flexed outlet fingers 202 and shifts them downwardly across the level 101A until the area 201A is communicated with the port 113 such that the ring 114 and the unloader seal 108 do not prevent fluid communication between the seal mandrel 107 and the unloader sleeve 201. The communication of the area 201A with the port 113 is detected when the end 204 and the outer abutment 205 at the lowermost end of the unloader sleeve 201 contacts and engages the shoulder 116 on the seal mandrel 107.

After reaching the desired setting depth, the tubing string, the tool RT, and the inner housing 100 together are rotated to the right. Right-hand rotational movement combined with downward movement of the tubing string will cause the body 118 to rotate to the right with respect to the control elements 701, the pin 704 within the bore 514 preventing companion right-hand rotation of the control elements 701 with respect to the drag block housing 511 and the body 118, such that the control elements 701 become disengaged from the threads 126 as the body 118 continues downward motion. As the undercut 125 moves downwardly with the body 118 immediate each control element 701, further rotation of the tubing string and the inner housing 100 is terminated after a known and predeterminable number of right-hand rotations. The tubular string, tool RT, and the inner housing 100 thereafter are moved downwardly with respect to the pack-off assembly 300, the booster assembly 400, the slip assembly 500 and the clutch assembly 600, these outer assemblies being held stationary with respect to the inner housing 100 by means of the securement of the face 515A of the blocks 515 onto the inner wall of the casing C.

It should be noted that each control element 701 is permitted to become threadedly disengaged from the threads 126 on the body 118 before the pack-off elements 311, 312 and 313 and the slip elements 504 and 508 are activated for contact with the casing C because of the distance between the end 409A of the tie sleeve 409 with respect to the shoulder 501A of the upper cone 501, and the screw 503 being permitted to travel within the slot 412 as the body 118, the pack-off assembly 300, and the booster assembly 400 carried therewith are moved downwardly for initial disengagement of the control elements 701.

After the control elements 701 have become disengaged from the threads 126 on the body 118, the inner housing 100 is continually shifted downwardly by means of downward motion of the tubular string, and the pack-off assembly 300, booster assembly 400 and the slip assembly 500 still are effectively secured to the body 118 because of interface of the face 509B of the lower cone 509 with the upper face 712 of the lock segment 706. As the body 118 moves downwardly, the lower end 124 of the threads 122 contacts the companion face or beveled shoulder 712A around the upper interior of the lock segments 706 to shove each segment 706 slightly outwardly by overcoming the resistance afforded by the upper and lower garter springs 707 to permit interengagement of the threads 122 and 711, such that, for each one-eighth inch travel of the body 118, the threads 711 contact an additional series of the buttress threads 122 on the body 118 to permit continued downward travel of the body 118.

As the lock segments 706 are permitted to travel along the body 118 on the threads 122, tubing weight is transmitted to the slip assembly 500 such that the screw 503 travels upwardly within the slot 412 on the tie sleeve 409 to permit interface of the end 409A of the sleeve 405 with the outer shoulder 501A of the upper cone 501. Now, tubing weight is transmitted through the mandrel 101, the seal mandrel 107, across the bearing 303 and the bearing race 304 to the packoff assembly 300 and the booster assembly 400 through the upper cone 501 into the upper slip 504, such that the upper cone 501 urges the upper slips 504 toward the inner face of the casing C for engagement of the teeth 504A within the casing C to hang and secure the bridge plug BP onto the casing C, the upper slips 504 traveling across the bevels 501B of the upper cone 501.

The bridge plug BP is thereafter placed into tension to insure that the bottom slips 508 are in contact with the casing C. Accordingly, the tubing string is pulled upwardly to make sure that the bevel slips are out and engaged upon the casing C to insure that they will resist upward load. The tubular string is pulled slightly upwardly through the J-pin mandrel 101 and the seal mandrel 107 and to the lock segments 706, thence through the lower cone 509, the upper face 712 of the lock segment 706 engaging the face 509B of the lower cone 509 to transmit this force to the lower cone 509 with the operation of the lock segment 706, thence to the slip element 508. Thus, assurance is given that the bridge plug BP will resist upward motion. Thereafter, the tubing string is set back down and the procedure is repeated to see if additional ratcheting motion between the body 118 and the lock segment 706 can be obtained and to assure that there is sufficient force trapped across the packing elements 311, 312 and 313 to hold pressure.

As the upper and lower slips 504 and 508 are secured to the casing C, tubing weight may be transferred to the bridge plug BP through the bearing 301, the bearing race 304 and the housing 306 to compress each of the pack-off elements 311, 312 and 313 for sealing engagement with the casing C. The inner housing 100 continues downward travel, thus carrying the lock nut 301, the housing 306, and the connector sleeve downwardly such that the floating key 316 is permitted to travel downwardly through the spline 413 on the stabilized sleeve 405 which, in turn, is held in stationary position because of the securement of the slip assembly 500 on the wall of the casing C. Accordingly, the downward tubing force is defined downwardly across the pack-off elements 311, 312 and 313 by transmission across the bearing 303 to the pack-off assembly 300 and is defined upwardly upon the pack-off elements through the sleeve 405 so that the pack-off elements 311, 312 and 313 are compressed by downward force expressed across the top of the pack-off element 311 and by upward force expressed across the pack-off element 313. The tubing string is permitted to continue downward travel a given distance which is defined as the amount of travel required to shift the lock segments 706 onto the threads 122 to urge the slip assembly 500 into engagement with the casing C and thereafter fully compress the pack-off elements 311, 312 and 313 along the casing C.

As the tubular string weight is slacked off, the lock segments 706 discontinue ratcheting with respect to the threads 122. If the tubular string thereafter is picked up, energy which has been stored within the pack-off elements 311, 312 and 313 will be released and the pack-off elements will try to return to their natural condition and become sealingly disengaged from securement on the inner wall of the casing C. However, because each lock segment 706 has been secured to the body 118 through the threads 122, the energy stored within the lock segments 706 is continued to be transmitted through the cone 509 and subsequently to the pack-off elements between the gauge ring 307 and gauge ring 404, thence through the bearing 303 through the body 118 and into the upper cone 501 and to the lower slips 508.

After the bridge plug has been set in the casing C as described above, the running and retrieval tool RT is manipulated to shift the unloader sleeve 201 upwardly to isolate the port 113 from the annular area between the casing C and the bridge plug BP to isolate the communication path above and below the bridge plug BP. The unloader sleeve 201 is caused to be shifted upwardly such that the fingers 202 again are placed within the groove above the bevel 101A on the J-pin mandrel 101, the ring 114 and the unloader seal 108 preventing fluid communication across the port 113. The bridge plug BP may be pressured from above or below, and the remedial operation conducted.

The tubing string is thereafter rotated a quarter of a turn to the right so that the J-pins 102 are disengaged from the running and retrieval tool RT and the tool RT is moved up hole. Thereafter, injection or squeezing may be conducted to the zone within the well above the bridge plug BP.

In order to remove sand, other debris and foreign material from above the bridge plug BP and the running and retrieval tool RT, a washing fluid is run down the interior of the tubular string and circulated through the tubingcasing annulus above the tools. Thereafter, the running and retrieval tool RT is then engaged to the tubular string and is affixed to the J-pins 102 on the J-pin mandrel 101. The unloader assembly 200 is automatically re-opened as the running tool RT is engaged to the bridge plug BP, allowing pressure equalization across the bridge plug BP. The tubing string is picked up and rotated to the right such that right-hand rotation causes the body 118 to move upwardly with respect to the slip assembly 500 and the exterior portions of the bridge plug BP affixed thereto. As the body 118 continues upward motion, the threads 711 on the lock segments 706 move downwardly with respect to the buttressed left-hand threads 122 on the body 118 and the body 118 becomes disengaged from the segments 706 to cause the packing elements 311, 312 and 313 to become relaxed. As the body 118 continues to be moved upwardly, the upper and lower slips 504 and 508 become disengaged from the casing C. As soon as the lock segments 706 reach the undercut 125 on the body 118, continued rotation is terminated. Thereafter, the tubular string is picked up and the control elements 701 are ratcheted back onto the body 118 by means of securement onto the threads 126. Accordingly, the bridge plug BP has been returned to its original running position and it may be retrieved up hole or the setting procedure may be repeated.

It should be noted that after the pack-off elements 311, 312 and 313 have been sealingly secured against the casing C, there is an area P2 immediate the connector sleeve 310 and the pack-off elements 311, 312 and 313 which is sensitive to the pressure differential from above to below the pack-off elements. Thus, in this direction, the magnitude of the differential pressure multiplied by the area P2 will be transmitted directly to the upper cone 501 and no longitudinal motion will be transmitted through the pack-off assemblies. Additionally, the area P3 is pressure sensitive, and if pressure thereacross from above is higher than that from below, this pressure will transmit an axial load on each of the packing elements 311, 312 and 313 which is transmitted thereto through the seal mandrel 107 and the bearing 303 to boost the pack-off assembly 300 to the more packed off position.

As set forth above, the bridge plug BP will maintain its pressure integrity as long as the pressure defined by the interface of the interior wall of the casing C with each of the packing elements 311, 312 and 313 is higher than the differential pressure within the well defined across the pack-off assembly 300. As the bridge plug BP is set, mechanical manipulation induces the packing-to-casing setting pressure. This pressure generally is sufficient to hold a given amount of pressure differential across the pack-off assembly 300 such that the component rubber in one or more of the packing elements 311, 312 and 313 will deteriorate by fracture, extrusion or compressive failure before the packing-to-casing seal is lost. Because of the construction of the bridge plug BP, the internal diameter of the casing is increased as the tool is being set and checked to assure sufficient packer-to-casing seal. As this seal pressure increases, the internal diameter of the casing also increases, somewhat correspondingly. Additionally, as each of the teeth 504A and 508A of the upper and lower slips 504 and 508, respectively, grip the casing, the component parts of the packer assembly 300 elongate due to the tensile load applied by the pressure at the packer-to-casing inerface which has resisted pressure differential. As the space for the packing elements 311, 312 and 313 increases, the elements will tend to "relax" or try to return to the original position, thereby reducing the contact pressure at the packer-casing interface. When this packer-casing interface pressure is reduced below the differential pressure which it is attempting to hold, differential pressure holding capability will be lost. Accordingly, the booster assembly 400 permits the pressure differential always to act upon the packing elements 311, 312 and 313 to assure sufficient packer-casing pressure to withhold differential pressure up to the point of extrusion failure of the packing elements themselves. It should be noted that the booster assembly 400 is not functional or required to maintain the packer-casing pressure when the pressure above the pack-off assembly 300 is higher than the pressure therebelow, the bridge plug BP being self-energizing when pressue is as above-described because the pressure will have a tendency to move the bridge plug BP further down the hole within the casing C such that the motion is resisted by the slip assembly 500. The high pressure above the assembly 300 acting on the area P3 causes the connector sleeve 310 to move down compressing the packing elements 311, 312 and 313 by contacting the tie sleeve 409, which, in turn, is interfaced with the upper cone 501. The force that is generated by the differential pressure is resisted by the upper slips 504 such that there is little or no relative movement between the body 118 and the slips 504. This differential pressure, multiplied by the area P3 of the body 118, results in a compressive load on the pack-off assembly 300 sufficient that the packing elements are able to resist the pressure acting on the packing elements at the area P1.

If pressure below the pack-off assembly 300 is higher than that thereabove, this differential pressure will act upon area P1, P2 and P3 to urge the bridge plug BP upwardly. However, this upward movement is resisted by the inner engagement of the teeth 508A into the inner wall of the casing C. The force created by this differential pressure acting on the area defined as P1 is transferred through the packing element assembly 300 to act upon the upper gauge ring 307, the bearing housing 306, the bearing race 304, the bearing 303, into the shouler 116B on protrusion 116, through the threads 117 and into the body 118 to urge the body 118 to move upward. Additionally, the body 118 is also urged upwardly by this differential pressure from below the packing assembly 300 acting upon area P3. The upward movement of the body 118 is resited through the threads 122 of the body 118, into the threads 711 of the lock segments 706, through the upper face 712 of the lock segments 706, into the face 509B of the lower cone 509, into the lower slip 508, and causes the teeth 508A into further securement with the inner wall of the casing C.

It should be noted that any axial deformation of the parts of the bridge plug BP subjected to tension or compression loading, in the act of resisting the forces created by the differential pressure acting on areas P1 and P3 tend to increase the allowable volume of the packing assembly 300. Also the further engagement of the teeth of the slips into the inner wall of the casing, and the increase in the casing inner diameter due to the increased pressure, both tend to increase the allowable volume of the packing assembly.

As described above, if the allowable volume of the packing assembly is allowed to increase sufficiently, the packing elements will relax and will not contain the pressure differential across the tool. For this reason area P2 has been provided. The differential pressure acting on area P2 causes the booster assembly 400 to move upward and create a compressive force on the packing assembly 300 which is sufficient to maintain the packing assembly in a packed off condition with the inner wall of the casing C. The upward force of the booster assembly is transferred through the packing element assembly 300 into the upper gauge ring 307 and through the various parts into the body 118 and lower slip 508 as previously described.

It should be particularly noted that this process of adding additional boost to the packing element assembly does not cause disengagement of the slip assembly from the inner wall of the casing. As the booster assembly 405 moves upward, the lower end 409A of 409 disengages from the shoulder 501A of the lower cone and thus, the movement of the booster sleeve and tie sleeve are independent of the stable upper cone. This permits the upper slip 504 to remain engaged with the inner wall of the casing C.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is desired to be secured by Letters Patent is:

1. A well tool adapted to be moved longitudinally in a well conduit comprising: normally retracted slip means; expander means relatively movable into engagement with said slip means to selectively expand said slip means against the well conduit; elastomeric packing means, said packing means being expandable exteriorly around said well tool and adapted to selectively seal with the well conduit; and booster means for transmitting to the packing means the compressive force resulting from a differential pressure across said packing means when said slip means are in expanded position and said packing means are sealed with the well conduit, whereby said packing means are maintained in sealing relationship with the well conduit.

2. A well tool adapted to be moved longitudinally in a well conduit comprising: normally retracted slip means; expander means relatively movable into engagement with said slip means to selectively expand said slip means against the well conduit; elastomeric packing means expandable exteriorly around said well tool and adapted to selectively seal with the well conduit; and booster means for transmitting to the packing means the compressive force resulting from the pressure differential defined by the increased pressure below said packing means and within said well conduit, said booster means transmitting said compressive force across said packing means when said slip means are in expanded position and said packing means are sealed with the well conduit, whereby said packing means are maintained in sealing relationship with the well conduit.

3. A well tool adapted to be set in a conduit within a well bore comprising: a body structure; normally retracted means on said body structure; means responsive to movement of said body structure in one direction relative to said normally retracted means for expanding said normally retracted means outwardly into engagement with said conduit; elastomeric packing means expandable exteriorly around said body structure and adapted to selectively seal with the conduit; booster sleeve means defining an effective pressure area thereacross for transmitting to the packing means the compressive force defined by differential pressure across said packing means when said packing means are in sealing relationship with said conduit; first releaseable clutch means acting between said body structure and said normally retracted means for preventing such movement of said body structure relative to said normally retracted means; and second normally released but selectively engagable clutch means acting between said body structure and said normally retracted means for permitting movement of said body structure relative to said normally retracted means to urge said normally retracted means outwardly and into engagement with said conduit and to selectively lock said normally retracted means in the outwardly expanded position.

4. A well tool adapted to be set in a conduit of a well bore comprising: a body structure; normally retracted means on said body structure; means responsive to movement of said body structure in one direction relative to said normally retracted means for expanding said normally retracted means outwardly into engagement with said conduit; elastomeric packing means expandable exteriorly around said body structure and adapted to selectively seal with the conduit; booster sleeve means defining an effective pressure area thereacross for transmitting to the packing means the compressive force defined by differential pressure acting across said packing means when said packing means are in sealing relationship with said conduit; first releaseable clutch means acting between said body structure and said normally retracted means for preventing such movement of said body structure relative to said normally retracted means; and second normally released but selectively engagable clutch means acting between said body structure and said normally retracted means for permitting movement of said body structure relative to said normally retracted means to urge said normally retracted means outwardly and into engagement with said conduit and to selectively lock said normally retracted means in the outwardly expanded position.

5. A well tool adapted to be set in a conduit of a well bore comprising: a body structure; normally retracted means on said body structure; means responsive to movement of said body structure in one direction relative to said normally retracted means for expanding said normally retracted means outwardly into engagement with said conduit; elastomeric packing means expandable exteriorly around said body structure and adapted to selectively seal with the conduit; booster sleeve means defining an effective pressure area thereacross for transmitting to the packing means the compressive force defined by differential pressure acting across said packing means when said packing means are in sealing relationship with said conduit; first releaseable clutch means acting between said body structure and said normally retracted means for preventing such movement of said body structure relative to said normally retracted means; and second normally released but selectively engagable clutch means acting between said body structure and said normally retracted means for permitting movement of said body structure relative to said normally retracted means to urge said normally retracted means outwardly and into engagement with said conduit and to selectively lock said normally retracted means in the outwardly expanded position.

6. A well tool adapted to be set in a conduit within a well bore comprising: a body structure; normally retracted means on said body structure; means responsive to movement of said body structure in one direction relative to said normally retracted means for expanding said normally retracted means outwardly into engagement with said conduit; elastomeric packing means expandable exteriorly around said body structure and adapted to selectively seal with the conduit; booster sleeve means defining an effective pressure area thereacross for transmitting to the packing means the compressive force defined by differential pressure acting across said packing means when said packing means are in sealing relationship with said conduit; first releaseable clutch means acting between said body structure and said normally retracted means for preventing such movement of said body structure relative to said normally retracted means; and second normally released but selectively engagable clutch means acting between said body structure and said normally retracted means for permitting movement of said body structure relative to said normally retracted means to urge said normally retracted means outwardly and into engagement with said conduit and to selectively lock said normally retracted means in the outwardly expanded position, said differential pressure being defined as the difference between the increased pressure below said packing means and within said conduit and the pressure in said conduit above said packing means.

7. A well tool adapted to be set in a well bore comprising: a body structure; normally retracted means on said body structure; means for expanding said normally retracted means outwardly and including booster sleeve means exerting a force tending to retain said normally retracted means in expanded condition; first releaseable clutch means acting between said body structure and said normally retracted means for preventing said normally retracted means from being expanded outwardly; and second releaseable clutch means acting between said body structure and said normally retracted means for locking said normally retracted means in the outwardly expanded position.

8. A well tool adapted to be moved longitudinally in a well conduit comprising: first and second normally retracted slip means; first and second expander means relatively movable into engagement with said first and second slip means, respectively, to selectively expand each of said slip means against the well conduit, one of said first and second slip means when in expanded position resisting downward movement of said well tool within said conduit and the other of said first and second slip means when in said expanded position resisting upward movement of said well tool within said conduit; elastomeric packing means expandable exteriorly around said well tool and adapted to selectively seal with the well conduit; and booster means functional with one of said first and second slip and expander means for transmitting to the packing means the compressive force defined by differential pressure acting across said packing means when said slip means are in expanded position and said packing means are sealed with the well conduit, whereby said packing means are maintained in sealing relationship with the well conduit.

9. A well tool adapted to be moved longitudinally in a well conduit comprising: first and second normally retracted slip means; first and second expander means relatively movable into engagement with said first and second slip means, respectively, to selectively expand each of said slip means against the well conduit, one of said first and second slip means when in expanded position resisting downward movement of said well tool within said conduit and the other of said first and second slip means when in said expanded position resisting upward movement of said well tool within said conduit; elastomeric packing means expandable exteriorly around said well tool and adapted to selectively seal with the well conduit; and booster means functional with at least one of said first and second slip and expander means for transmitting to the packing means the compressive force defined by differential pressure acting across said packing means when said slip means are in expanded position and said packing means are sealed with the well conduit whereby said packing means are maintained in sealing relationship with the well conduit.

10. A well tool adapted to be moved longitudinally in a well conduit comprising: first and second normally retracted slip means; first and second expander means relatively movable into engagement with said first and second slip means, respectively, to selectively expand each of said slip means against the well conduit, one of said first and second slip means when in expanded position resisting downward movement of said well tool within said conduit and the other of said first and second slip means when in said expanded position resisting upward movement of said well tool within said conduit; elastomeric packing means expandable exteriorly around said well tool and adapted to selectively seal with the well conduit; and booster means functional with one of said first and second slip and expander means for transmitting to the packing means the compressive force defined by differential pressure acting across said packing means when said slip means are in expanded position and said packing means are sealed with the well conduit, whereby said packing means are maintained in sealing relationship with the well conduit, said differential pressure being defined as the difference between the increased pressure below said packing means and in said conduit and the pressure in said conduit above said packing means.

11. A well tool adapted to be moved longitudinally in a well conduit comprising: first and second normally retracted slip means; first and second expander means relatively movable into engagement with said first and second slip means, respectively, to selectively expand each of said slip means against the well conduit, one of said first and second slip means when in expanded position resisting downward movement of said well tool within said conduit and the other of said first and second slip means when in said expanded position resisting upward movement of said well tool within said conduit; elastomeric packing means expandable exteriorly around said well tool and adapted to selectively seal with the well conduit; and booster means functional with one of said first and second slip and expander means for transmitting to the packing means the compressive force defined by differential pressure acting across said packing means when said slip means are in expanded position and said packing means are sealed with the well conduit, whereby said packing means are maintained in sealing relationship with the well conduit and resist contraction, said differential pressure being defined as the difference between the increased pressure below said packing means and in said conduit and the pressure in said conduit above said packing means.

12. A well tool adapted to be moved longitudinally in a well conduit comprising: a plurality of normally retracted slip means; a plurality of expander means relatively movable into engagement with said slip means to selectively expand said slip means against the well conduit; elastomeric packing means expandable exteriorly around said well tool and adapted to selectively seal with the well conduit; and booster sleeve means for transmitting to the packing means the compressive force defined by differential pressure acting across said packing means when said slip means are in expanded position and said packing means are sealed with the well conduit whereby said packing means are maintained in sealing relationship with the well conduit, said booster sleeve means acting in association with at least one of said slip means to transmit the compressive force of said differential pressure across said packing means.

* * * * *